US008757267B2

(12) United States Patent
Mitchell et al.

(10) Patent No.: US 8,757,267 B2
(45) Date of Patent: Jun. 24, 2014

(54) PRESSURE RANGE DELIMITED VALVE WITH CLOSE ASSIST

(75) Inventors: Bruce Mitchell, Calgary (CA); Gordon Bosley, Cherry Grove (CA)

(73) Assignee: Bosley Gas Lift Systems Inc.

( * ) Notice: Subject to any disclaimer, the term of this patent is extended or adjusted under 35 U.S.C. 154(b) by 247 days.

(21) Appl. No.: 13/330,938

(22) Filed: Dec. 20, 2011

(65) Prior Publication Data

US 2012/0152552 A1 Jun. 21, 2012

Related U.S. Application Data

(60) Provisional application No. 61/424,928, filed on Dec. 20, 2010.

(51) Int. Cl.

| | |
|---|---|
| ***E21B 33/00*** | (2006.01) |
| ***E21B 34/00*** | (2006.01) |
| ***E21B 43/00*** | (2006.01) |
| ***E21B 33/12*** | (2006.01) |
| ***E21B 34/06*** | (2006.01) |
| ***F16K 31/44*** | (2006.01) |
| ***F16K 31/12*** | (2006.01) |
| ***F01L 3/10*** | (2006.01) |

(52) U.S. Cl.

USPC ..... 166/323; 166/319; 166/320; 166/325; 166/386; 166/373; 166/322.1; 251/75; 251/337; 251/28

(58) Field of Classification Search

USPC ..... 166/321, 323, 386, 325, 319, 332.1, 166/374, 373; 251/72, 337, 343, 344

See application file for complete search history.

(56) References Cited

U.S. PATENT DOCUMENTS

| | | | | |
|---|---|---|---|---|
| 3,861,414 | A * | 1/1975 | Peterson, II | 137/512.3 |
| 4,220,176 | A * | 9/1980 | Russell | 137/496 |
| 7,331,392 | B2 * | 2/2008 | Bosley et al. | 166/323 |

* cited by examiner

*Primary Examiner* — Brad Harcourt
*Assistant Examiner* — Steven MacDonald
(74) *Attorney, Agent, or Firm* — Sean W Goodwin; Linda M Thompson

(57) ABSTRACT

A pressure-actuated valve fit to a tubing string for alternately closing to communicate fluids from a wellbore to the tubing string and opening to communicate fluids from a wellbore annulus to the tubing string. The valve is particularly useful for lifting liquids which accumulate in the tubing string when the reservoir has a diminished pressure. In this case, gas is accumulated in the wellbore annulus and when the valve is opened the gas enters the valve and is directed to the tubing string for lifting the liquids. The valve is closed by a spring and has a closing-assist which applies an additional force to the spring to ensure the valve is fully closed.

25 Claims, 15 Drawing Sheets

PRESSURE RANGE DELIMITED VALVE WITH CLOSE ASSIST

CROSS-REFERENCE TO RELATED APPLICATIONS

This application claims the benefit of U.S. provisional application 61/424,928, filed Dec. 20, 2010, the entirety of which is incorporated herein by reference.

FIELD OF THE INVENTION

Embodiments of the invention relate to valves which are actuated by pressure differentials across the valve and more particularly to valves which are operable at high pressure differentials, which can be actuated to shift reliably to the closed position and which are particularly suitable for unloading accumulated water from gas production wellbores.

BACKGROUND OF THE INVENTION

Valves are known which operate to open or close due to a pressure differential across the valve for a variety of uses. Conventional pressure-actuated valves typically open at a first pressure and dynamically close as the pressure drops, throttling the flow through the valve. Further, many conventional valves must be reset other than by pressure, relying on some electrical or other means to reset the valve to a starting open or closed position.

One such use, where it is desirable that a valve remain open for a period of time and to reset to a closed position under certain conditions, is in the unloading of accumulated water from a gas production wellbore. Another is the periodic lifting of production liquids from a low or diminished pressure wellbore using periodic high pressure gas. Further, in the case where the valve is to be situated remotely downhole in a wellbore, it is desirable that control means for the opening and resetting the valve be both simple and reliable.

More particularly in the production of hydrocarbons, particularly from gas wells, the accumulation of liquids, primarily water, has presented great challenges to the industry. As the liquid builds at the bottom of the well, a hydrostatic pressure head is built which can become so great as to overcome the natural pressure of the formation or reservoir below, eventually "killing" the well.

A fluid effluent, including liquid and gas, flows from the formation. Liquid accumulates as a result of condensation falling out of the upwardly flowing stream of gas or from seepage from the formation itself. To further complicate the process, the formation pressure typically declines over time. Once the pressure has declined sufficiently so that production has been adversely affected, or stopped entirely, the well might be abandoned or rehabilitated. Most often the choice becomes one of economics, wherein the well is only rehabilitated if the value of the unrecovered resource is greater than the costs to recover it.

A number of techniques have been employed over the years to attempt to rehabilitate wells with diminished reservoir pressure. One common technique has been to shut in or "stop cock" the well to allow the formation pressure to build over time until the pressure is again sufficient to lift the liquids when the well is opened again. Unfortunately, in situations where the formation pressure has declined significantly, it can take many hours to build sufficient pressure to blowdown or lift the liquids, reducing the hours of production. Applicant is aware of wells which must be shut in for 12-18 hours in order to obtain as little as 4 hours of production time before the hydrostatic head again becomes too large to allow viable production.

Two other techniques, plunger and gas lift, are commonly used to enhance production from low pressure reservoirs. A plunger lift production system typically uses a small cylindrical plunger which travels freely between a location adjacent the formation to a location at the surface. The plunger is allowed to fall to the formation location where it remains until a valve at the surface is opened and the accumulated reservoir pressure is sufficient to lift the plunger and the load of accumulated liquid to the surface. The plunger is typically retained at the wellhead in a vertical section of pipe and associated fitting at surface, called a lubricator, until such time as the flow of gas is again reduced due to liquid buildup. The valve is closed at the surface which "shuts in" the well. The plunger is allowed to fall to the bottom of the well again and the cycle is repeated. Shut-in times vary depending upon the natural reservoir pressure. The pressure must build sufficiently in order to achieve sufficient energy, which when released, will lift the plunger and the accumulated liquids. As natural reservoir pressure diminishes, the required shut-in times increase, again reducing production times.

Typically, a gas lift production system for more sustained production of liquid hydrocarbons utilizes injection of compressed gas into the wellbore annulus to aerate the production fluids, particularly viscous crude oil, to lower the density and aid in flowing the resulting gas/oil mixture more readily to the surface. The gas is typically separated from the oil at the surface, re-compressed and returned to the wellbore. Gas lift methods can be continuous wherein gas is continually added to the tubing string, or gas lift can be performed periodically. In order to supply the large volumes of compressed gas required to perform conventional gas lift, large and expensive systems, requiring large amounts of energy, are required. Gas is typically added to the production tubing using gas lift valves directly tied into the production tubing or optionally, can be added via a second, injection tubing string. Complex crossover elements or multiple standing valves are required for implementations using two tubing strings, which add to the maintenance costs and associated problems.

A combination of gas lift and plunger lift technologies has been employed in which plungers are introduced into gas lift production systems to assist in lifting larger portions of the accumulated fluids. For greater detail, one can refer to U.S. Pat. No. 6,705,404, issued Mar. 16, 2004, and U.S. Pat. No. 6,907,926 which issued on Jun. 21, 2005, both of which issued to the applicant Gordon Bosley, the entirety of which are incorporated herein by reference. In gas lift alone, the gas propelling the liquid slug up the production tubing can penetrate through the liquid, causing a portion of the liquid to escape back down the well. Plungers have been employed to act as a barrier between the liquid slug and the gas to prevent significant fall down of the liquid. Typically, the plunger is retained at the top of the wellhead during production and then caused to fall only when the well is shut in and the while the annulus is pressurized with gas. This type of combined operation still requires that the well be shut in and production be halted each time the liquid is to be lifted.

In the case of slant wells or directional wellbores, plunger lift systems are largely inoperable as the plunger will not fall down the wellbore as it does in a vertical wellbore. Thus, one must rely on a form of gas lift alone or on the use of pressure-actuated valves, as discussed above, which alternately open and close the production tubing to permit energy stored in the annulus to cause liquids to be lifted to surface. Conventional pressure-actuated valves however require complex control mechanisms to permit maintaining the valve in a closed position for sufficient time to build the necessary energy in the annulus to lift the liquids and then to remain open for sufficient time to permit the energy to be discharged into the production tubing for lifting the fluids to surface. Conventional valves for periodic release of gas use springs, diaphragms and bellows to attempt to maintain a pressure differential sufficient to periodically discharge the gas while maintaining the valve in an open position for a sufficient amount of time to lift the liquids. Typically, such valves are only capable of maintaining a pressure differential of about 50 psi, which is largely insufficient to permit enough gas to sweep liquids to surface.

Clearly, there is a need for a valve which is reliably opened at pressure differentials as great as about 400 psi and maintained in the open position for a period of time after which the valve is reset to a closed position. Particularly, such a valve would be desired for use in the case of wells having declining natural reservoir pressure, for apparatus and methods that would allow the energy within the annulus to be augmented for lifting the accumulated liquids in the well, without a requirement to shut in the well and halt production and to ensure the valve is controlled to remain open for a sufficient period to effectively discharge the accumulated fluids from the well and then to reset.

SUMMARY OF THE INVENTION

Valves according to embodiments of the invention are particularly useful for unloading liquids which accumulate in a wellbore, such as when the reservoir pressure has diminished. The valves incorporate a pressure-actuated pilot valve which opens at a preset high pressure and which closes at a preset low pressure. The pilot valve is in constant pressure communication with a wellbore annulus which is charged with compressed gas for pressurizing the annulus. As wellbore fluids are produced from the reservoir, the fluids bypass the valve and flow through a production tubing string to surface.

When the pressure in the wellbore annulus exceeds a preset high pressure, production from the wellbore is blocked by a one-way valve in the tubing string. The pilot valve opens, causing a plunger to move axially within the valve and open inlet ports for admitting gas from the wellbore annulus to the valve and into the tubing string for lifting accumulated liquids therein to surface. Thereafter, when the gas is discharged and the wellbore annulus pressure drops to a preset low pressure, the pilot valve is biased closed causing the plunger to block the inlet ports and production resumes. A valve-closing assist is provided to ensure that once the valve has closed that it is fully closed and the plunger completely blocks the flow of annulus gas to the valve.

Therefore in a broad aspect, a system is provided for enhancing gas recovery from a wellbore which extends to a reservoir having diminished pressure. The wellbore has a tubing string therein. A packer is set above perforations in the tubing string and forms a wellbore annulus thereabove. Compressed gas pressurizes the wellbore annulus. Liquids accumulate in a bore of the tubing string as wellbore gas is produced therethrough to surface. The system comprises a one-way valve at a bottom of the tubing string for one-way fluid communication from the reservoir to the tubing string. A pressure-actuated valve is housed in the bore of the tubing string uphole from the one-way valve and forms a production annulus therebetween in fluid communication with the tubing annulus. The pressure-actuated valve comprises a valve body having a valve bore, inlet ports for fluid communication between the wellbore annulus and the valve bore; outlet ports in the valve body, spaced downhole from the inlet ports, for fluid communication between the valve bore and the production annulus; a plunger axially moveable in the valve bore, uphole from the inlet ports, for alternately blocking the inlet ports for preventing gas accumulating in the wellbore annulus from entering the valve body in a closed, production position; and unblocking the inlet ports for admitting gas from the wellbore annulus to the valve bore and flowing through the outlet ports to the production annulus for lifting accumulated fluids therein to surface in an open, lift position; a main spring operatively connected to the plunger for normally biasing the plunger to the production position; and a pressure-actuated pilot valve positioned in the valve bore and in continuous pressure communication with the wellbore annulus. When the pressure in the wellbore annulus exceeds a preset high pressure, the pilot valve opens to communicate the high pressure to the plunger for overcoming the biasing and moving the plunger from the production position to the open, lift position. When the pressure in the wellbore annulus is below a preset low pressure, the pilot valve releases the pressure acting at the plunger, allowing the plunger to be biased from the lift position to the closed, production position.

The system further comprises a valve closing assist for releasing energy to the plunger for ensuring the plunger is in the production position after the plunger has been actuated to move to the production position.

BRIEF DESCRIPTION OF THE DRAWINGS

FIG. 7A illustrates the kicker sleeve locked to the valve body; and FIG. 7B illustrates the sleeve engaged to the kicker spring mandrel and released or unlocked to urge the valve to the closed position.

BRIEF DESCRIPTION OF EMBODIMENTS OF THE INVENTION

Figure 1A:
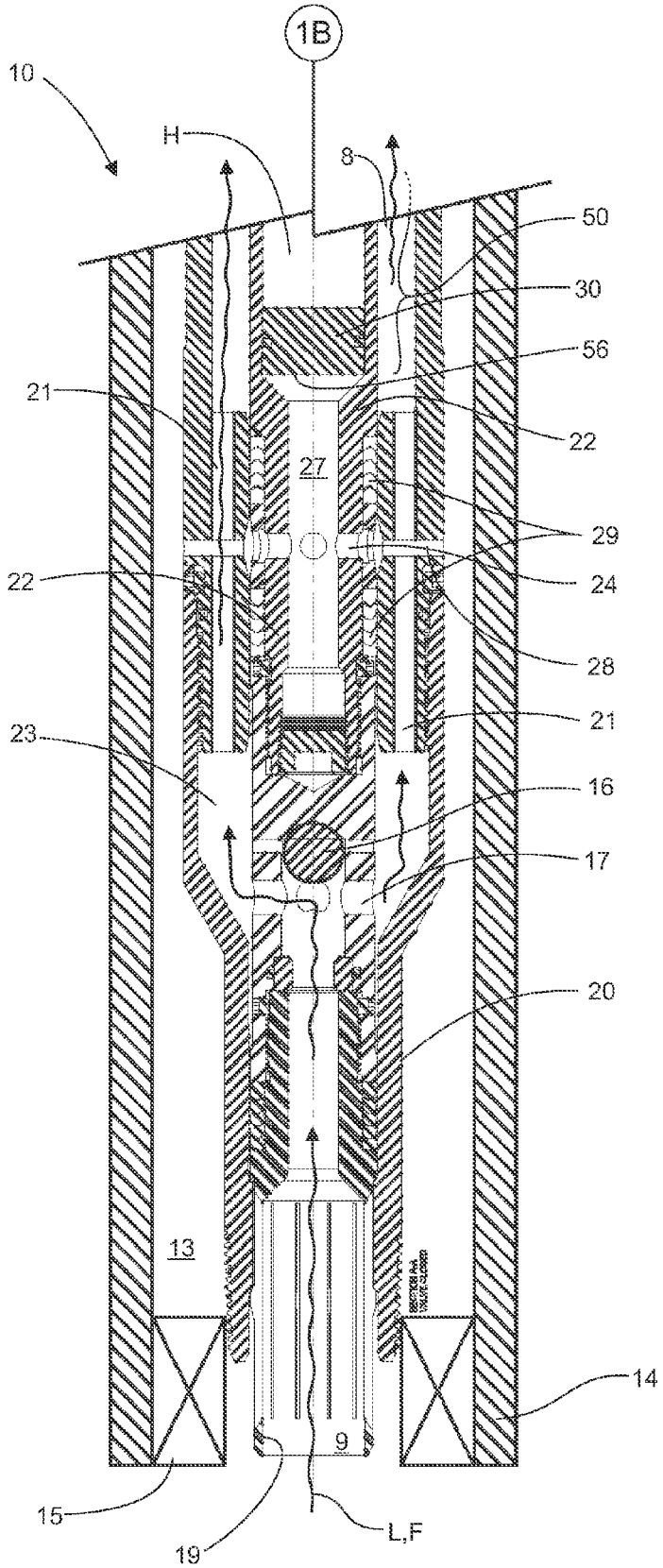
FIGS. 1A, 1B and 1C form a longitudinal sectional view of a valve according to one embodiment, the valve shown in a closed, production position.

As described herein, valve 10, is actuated by a high pressure to open and biased under lower pressures to close. Valve closing or kicker means are provided for assisting the valve to close fully.

With reference to FIGS. 1A-1C and 1D-1F, it is convenient to illustrate the operation of one embodiment of the valve 10 for the control of production fluids F and removal of accumulated liquids L from a wellbore 9. The wellbore 9 is cased with a casing string 14 and a tubing string 11 extends down the cased wellbore 9, having a downhole end located for receipt of the production fluids F. The valve 10 is located in a bore 12 of the downhole end of the tubing string 11.

A wellbore annulus 13 is formed between the tubing string 11 and the casing string 14. In this embodiment a packer 15, shown in a fanciful schematic form only and with non-pertinent downhole components of the valve or downhole assembly omitted, seals the wellbore annulus 13 so that production fluids F from the wellbore 9 are directed into the tubing string 11 and through the valve 10. The packer isolates the wellbore below the packer 15 from the wellbore annulus 13 above.

The valve 10 has a production position in which production fluids F flow to surface. During production, liquids L can accumulate in the tubing string bore 12 negatively impacting production. The valve has a lift position in which accumulated liquid is lifted with compressed gas G which is directed through the valve 10 from the wellbore annulus 13.

In this gas well embodiment, it is advantageous to use the wellbore annulus 13 to accumulate lift gas G to an elevated or high pressure (HP) sufficient to periodically effect gas lift of accumulated liquids from the wellbore 9. The nature of the arrangement in this embodiment is that a small compressor can be used to accumulate compressed lift gas G in the annulus 13 at high pressure over a period of time and avoid the need for high capacity expensive compressors. The valve 10 controls the egress of lift gas G from the wellbore annulus 13 and into the tubing string 11.

With reference now in detail to FIGS. 1A-1C, 1D-1F, 2A, 2B, 3A-3C and 4A-4C, the valve 10 is operable between two positions, a first, closed, production position (FIGS. 1A-1C, 2A and 3A-3C) in which production fluid, such as product gas and unwanted liquid from the wellbore 9 is directed to surface through a production bore 12 in the tubing string 11, and a second, open, lift position (FIGS. 1D-1F, 2B and 4A-4C) in which the wellbore 9 is isolated and accumulated lift gas G is redirected from the wellbore annulus 13 above the packer 15 to lift accumulated liquids L up the tubing string 11.

In the first production position, while lift gas G is being compressed and stored in the wellbore annulus 13, formation production fluids F from the wellbore 9 are allowed to flow to surface through the tubing string 11. Liquids L also accumulate. In the second lift position, and at a preset high pressure, lift gas G from the wellbore annulus 13, is directed up the tubing string 11 to lift accumulated wellbore fluid L to the surface, such fluids including liquid oil and water, while production fluid F is temporarily blocked.

Figure 1B:
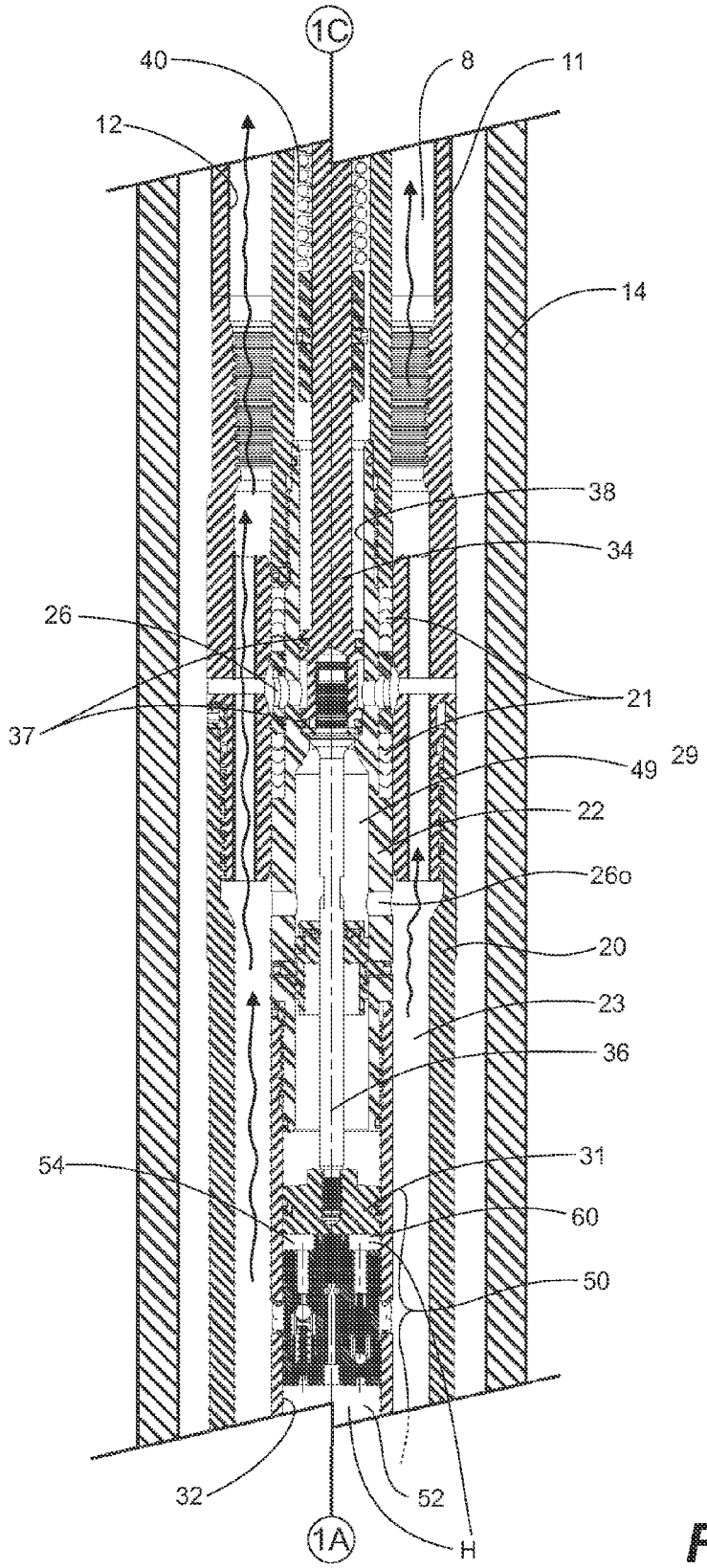
Figure 1C:
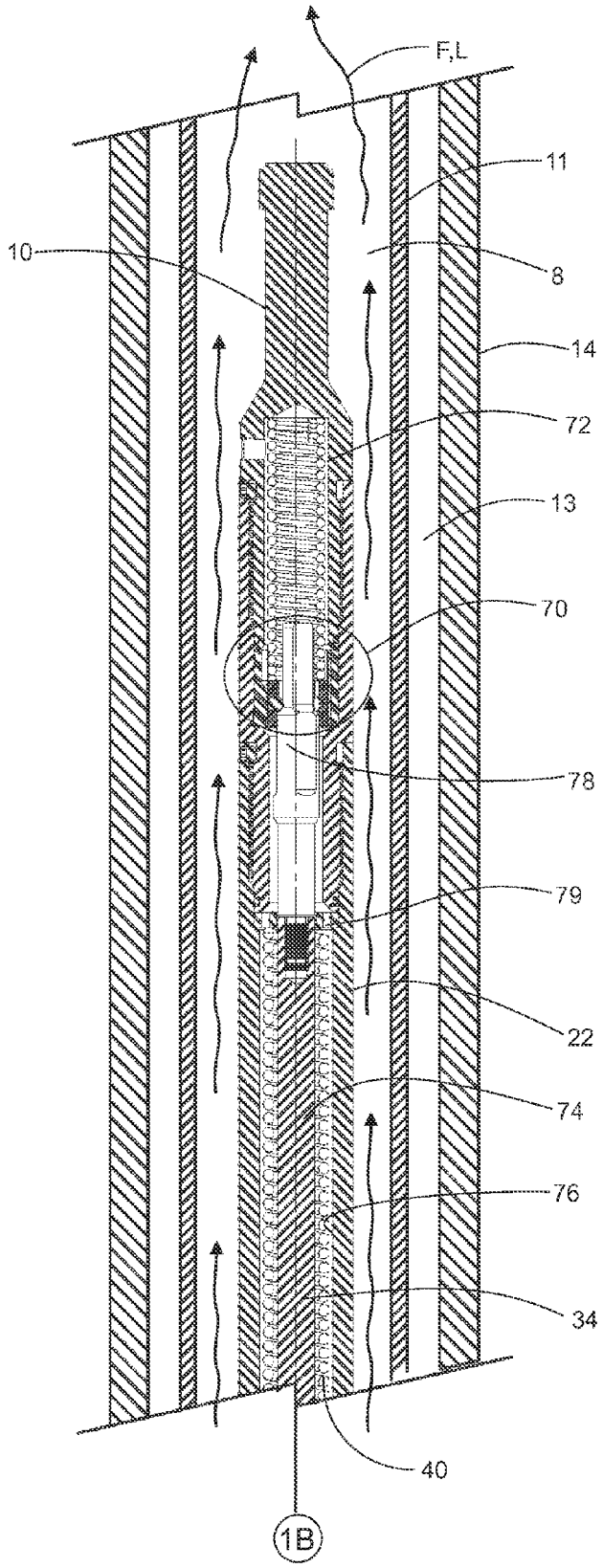

FIGS. 1A-1C illustrate production of production fluid F which includes liquid L. Lift gas G accumulates in the wellbore annulus 13 while liquid L accumulates in the tubing string 11. The bore 12 of the tubing string 11 is alternatively placed into communication with the wellbore 9 or the wellbore annulus 13 through the pressure-actuated valve 10. A downhole end of the tubing string 11 is fit with a check valve 16 for one-way fluid communication from the wellbore 9 into the tubing bore 12. The valve 10 is fit to the bore 12 of the tubing string 11 forming a tubing annulus 8 therebetween. The valve 10 has a valve body 22 formed with bypass passages 21.

In the first production position, the valve 10 enables flow of production fluid F and liquid L, entering from the wellbore 9 through check valve 16, to flow along the tubing annulus 8, through bypass passages 21 to bypass the valve 10 and flow up the tubing annulus 8 to the production bore 12 above the valve 10. In the lift position, the valve 10 is pressure-actuated to direct accumulated gas G in the wellbore annulus into the tubing annulus 8. The flow of gas G into the tubing annulus closes check valve 16, isolating the wellbore 9 in the lift position.

The valve 10 is in direct fluid communication with the wellbore annulus 13 through one or more gas lift inlet ports 26. The inlet ports 26 bypass the tubing annulus 8 and are formed through the tubing string 11 and valve body 22. The inlet ports 26 fluidly connect the wellbore annulus 13 and a valve bore 49 of the valve 10. In the second lift position, the inlet ports 26 are connected through the valve bore 49 to the tubing annulus 8 through outlet ports 26*o*.

The valve 10 is also in direct fluid communication with the wellbore annulus 13 through one or more actuating inlet passages 28, formed through the tubing string 11 through pilot inlets 24 in valve body 22.

The inlet ports 26 are alternately blocked and opened using a plunger 34. When the inlet ports 26 are blocked, the wellbore annulus 13 is blocked from the valve bore 49. When the inlet ports 26 are open, the wellbore annulus 13 is placed in communication with the valve bore 49 and gas G can flow through the valve bore 49 to outlet ports 26*o*.

A pressure-actuated pilot valve 50 is fit to the valve bore 49 and comprises a first floating piston 30 and a second piston 31, forming a hydraulic chamber 51 therebetween. A pressure modulator 53 is housed in the hydraulic chamber 51 forming first 52 and second 54 chambers, separated by the pressure modulator 53.

During production, with inlet ports 26 blocked by plunger 34, lift gas G accumulates in the wellbore annulus 13. The plunger 34 has seals 37 which, in the closed, production position straddle the inlet ports 26 for sealing against the valve body 22 and preventing the flow of lift gas G thereby. Accumulating lift gas G continuously enters valve 10 through actuating inlet passages 28, aligned with pilot inlets 24, and acts on the first, floating piston 30 in the valve body 22. The first piston 30 acts on and pressurizes the first chamber 52 having clean pilot liquid H, such as hydraulic fluid, therein. The pilot liquid H in the first chamber 52 acts on the pressure modulator 53.

While lift gas G pressure is below a preset threshold high pressure HP, production fluid F and liquid L from the wellbore 9 enters the valve 10 and flows through the tubing annulus 8. The rising gas pressure continues to act on the first piston 30 and to act on the pilot liquid H. When the lift gas G pressure reaches the threshold high pressure HP, the pressurized pilot liquid H causes a high pressure bypass valve 58 in the pressure modulator 53 to open to flow HP pilot liquid H from the first chamber 52 on one side of the pressure modulator 53 into the second chamber 54, formed on the opposite side of the pressure modulator 53. The pilot liquid H acts on the second piston 31. The second piston 31 is operatively connected, such as being attached, by a piston rod 36, to the plunger 34. Force on the second piston 31, generated by the pilot liquid H, acts to move the second piston 31, piston rod 36 and plunger 34 towards the open, lift position. The plunger 34 moves past inlet ports 26 to open and fluidly connect inlet ports 26 and outlet ports 26*o* through valve bore 49 between the piston rod 36 and the valve body 22.

Movement of the plunger 34 to the open, lift position is resisted by a main biasing spring 40. When the pressure of the pilot liquid H reaches the HP threshold, the force on the second piston 31 overcomes the biasing force of the main biasing spring 40 and the plunger 34 moves sufficiently to open inlet ports 26.

A valve-closing assist 70, such as a kicker spring 72, is energized as the plunger 34 is moved to the open, lift position and is set and locked in the energized state, as discussed in greater detail below. The kicker spring 72 remains energized, but idle, until the valve 10 is actuated to the closed, production position.

Figure 1D:
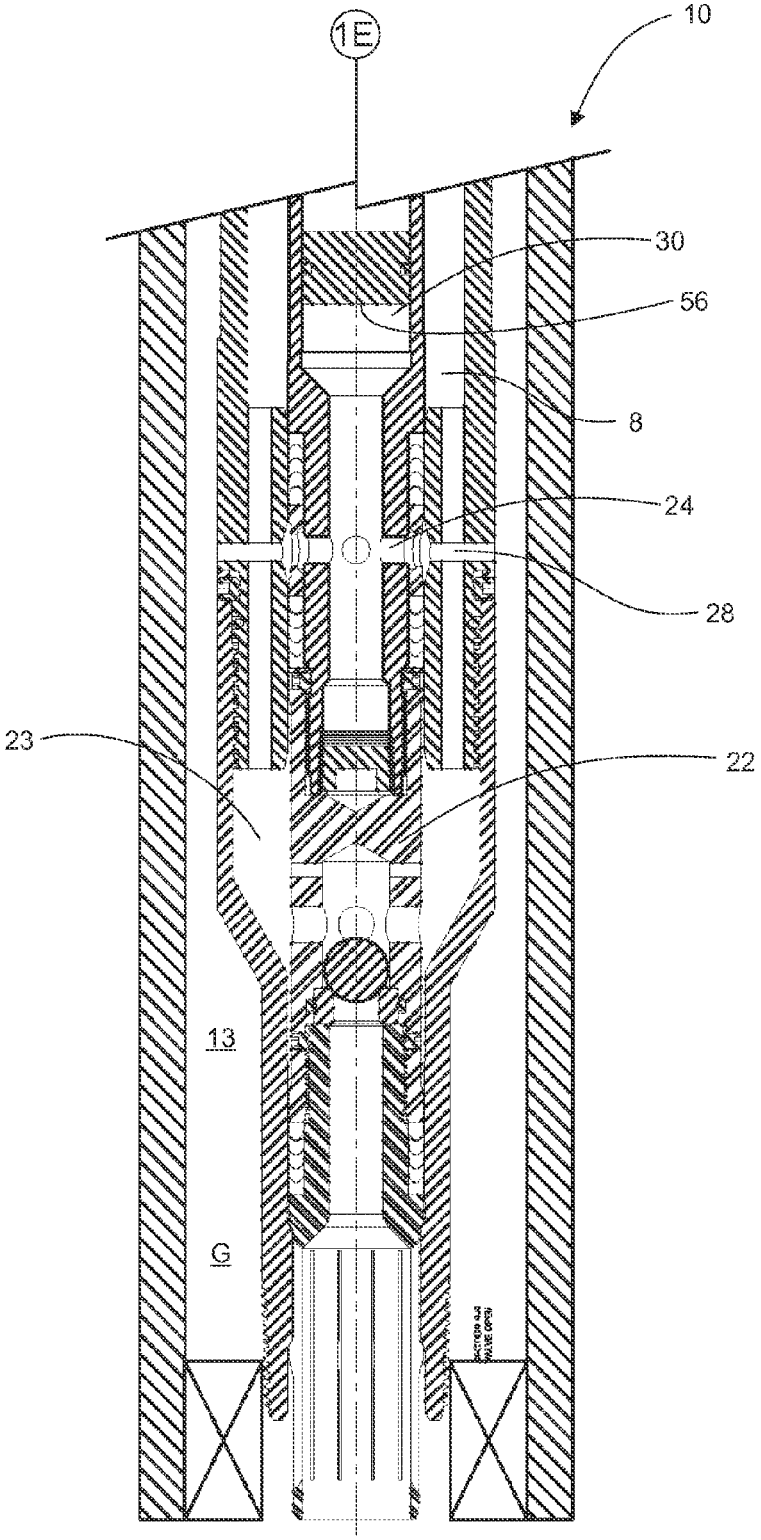
FIGS. 1D, 1E and 1F form a longitudinal sectional view of a valve according to FIG. 1A shown in an open, lift position for lifting accumulated fluids to surface using gas accumulated in an annulus between the tubing string and the casing string during production of fluids from a reservoir.
Figure 1E:
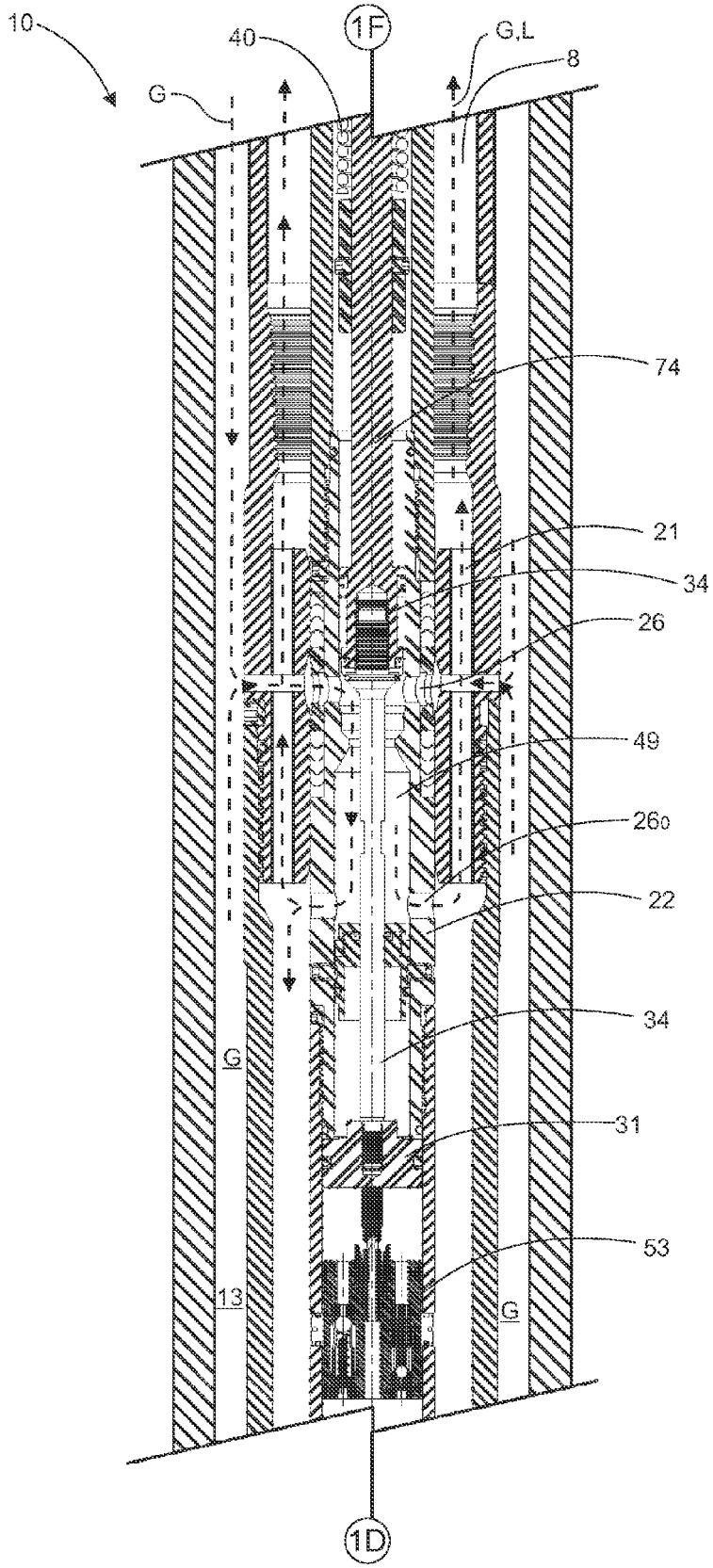
Figure 1F:
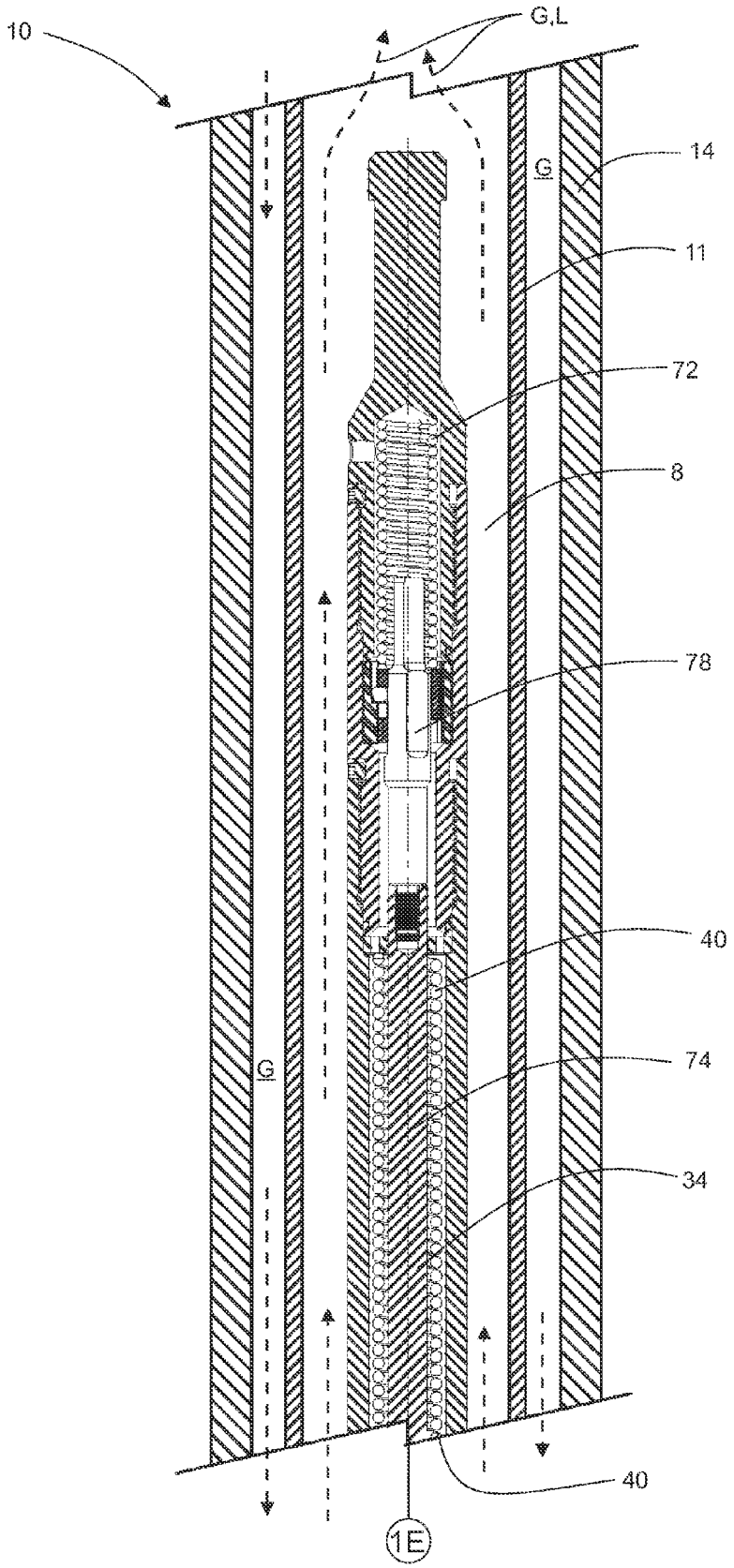
Figure 2A:
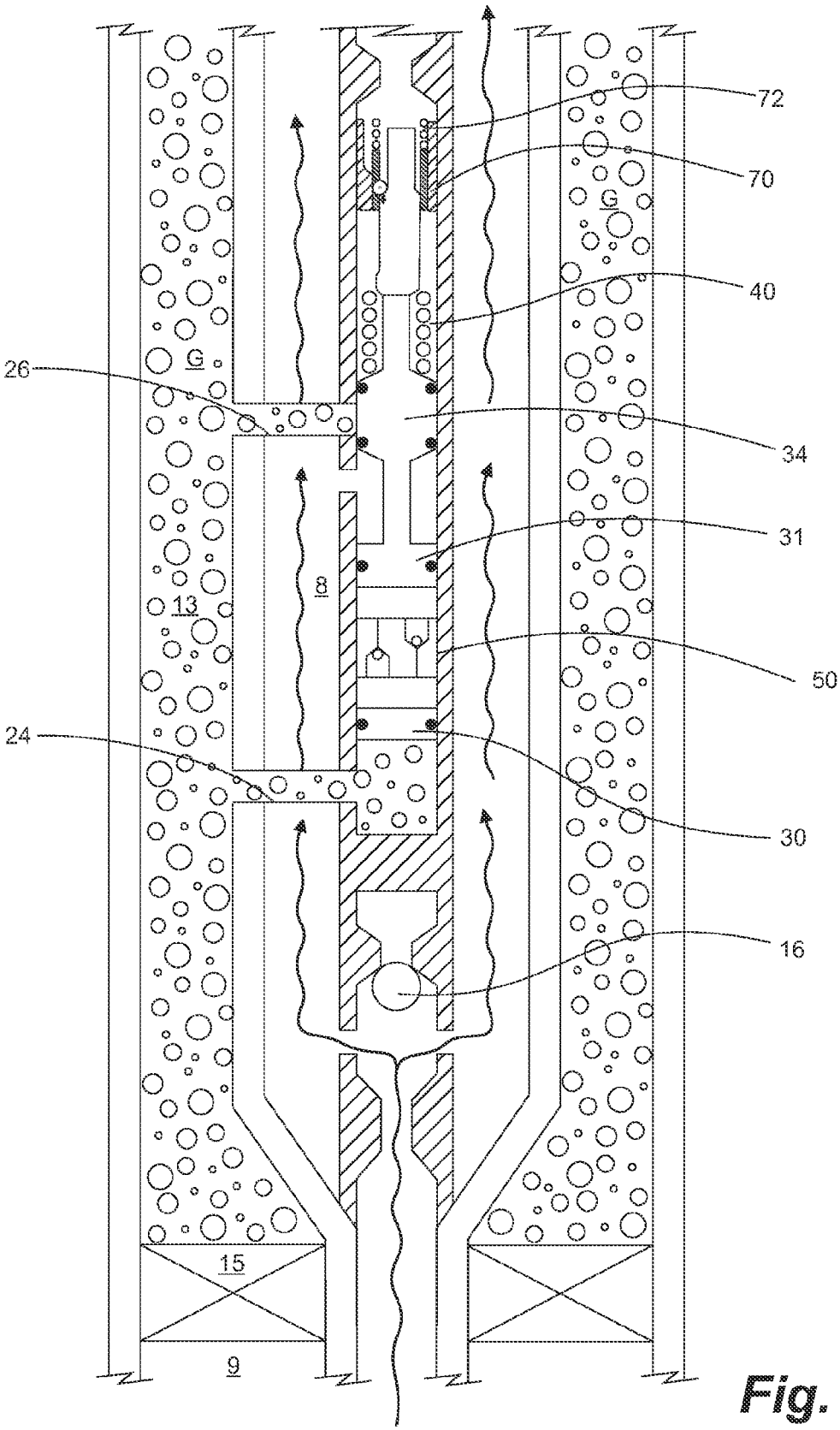
FIG. 2A is a simplified schematic of a wellbore system with the valve in a production position.
Figure 2B:
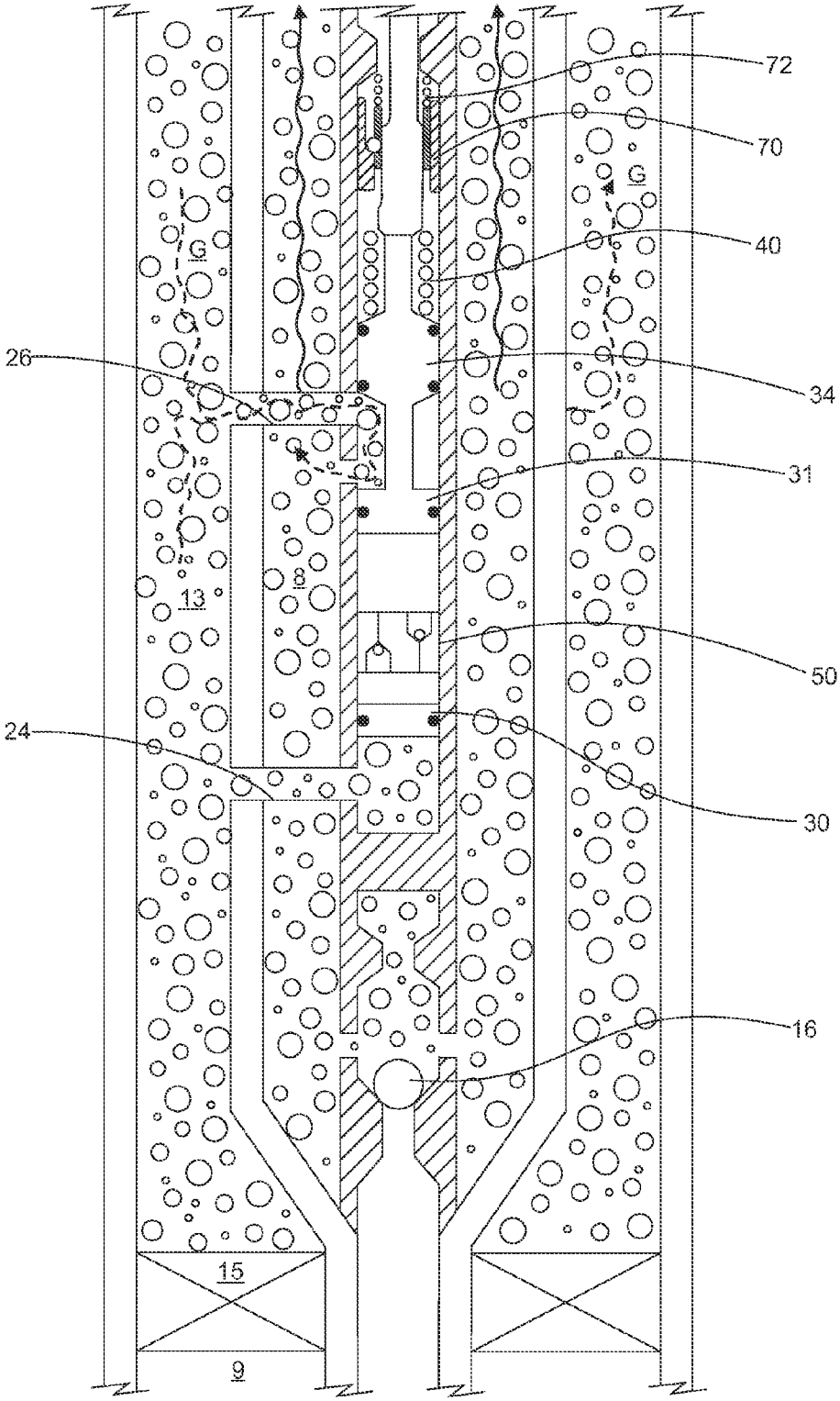
FIG. 2B is a simplified schematic of the wellbore system of FIG. 2A with the valve in a lift position.

As shown in FIGS. 1D-1F, when the inlet ports 26 open, accumulated lift gas G is released from the wellbore annulus 13, through the inlet ports 26 and into the valve 10. The piston rod 36 spaces the second piston 31 sufficiently from the plunger 34 to permit the gas to flow therebetween into the valve bore 49 and to the outlet ports 26*o*. Gas G then flows to the production annulus 23 and through the bypass passages 21 for lifting accumulated liquid L in the tubing annulus 8 to surface.

As gas G discharges up the tubing annulus 8, the gas pressure diminishes. Eventually, the gas pressure drops to a second, lower, closing pressure at a preset low threshold pressure LP.

As the pressure on the first piston 30 diminishes, as communicated through actuating inlet passageways 28, the available force on the second piston 31 correspondingly diminishes. The main spring 40 overcomes the diminished force on the second piston 31 and moves the plunger 34 to close the inlet ports 26. The pressure modulator 53 controls the return of pilot liquid H from the second chamber 54 to the first chamber 52.

As the plunger 34 nears the closed position, the kicker spring 72 is released, which releases the stored energy into the plunger 34 to ensure the plunger 34 completely closes in the production position. The process repeats as the pressure of the gas G in the annulus 13 cycles between high pressure HP and low pressure LP.

Figure 4A:
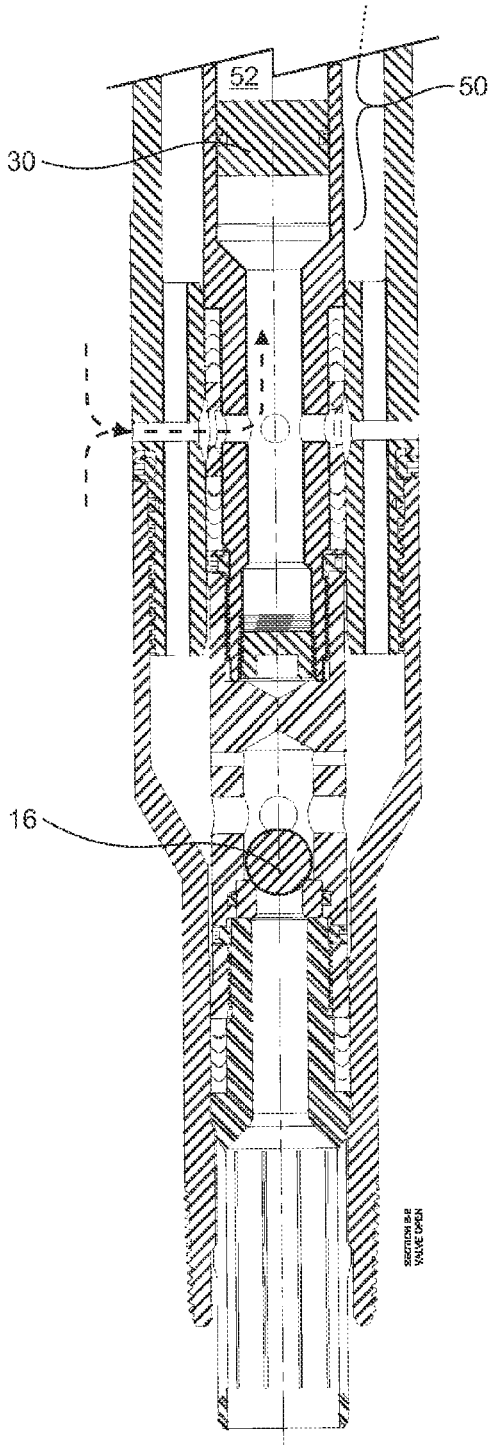
FIGS. 4A-4C are partial longitudinal sectional views according to FIGS. 1D-1F, in the open, lift position.
Figure 3A:
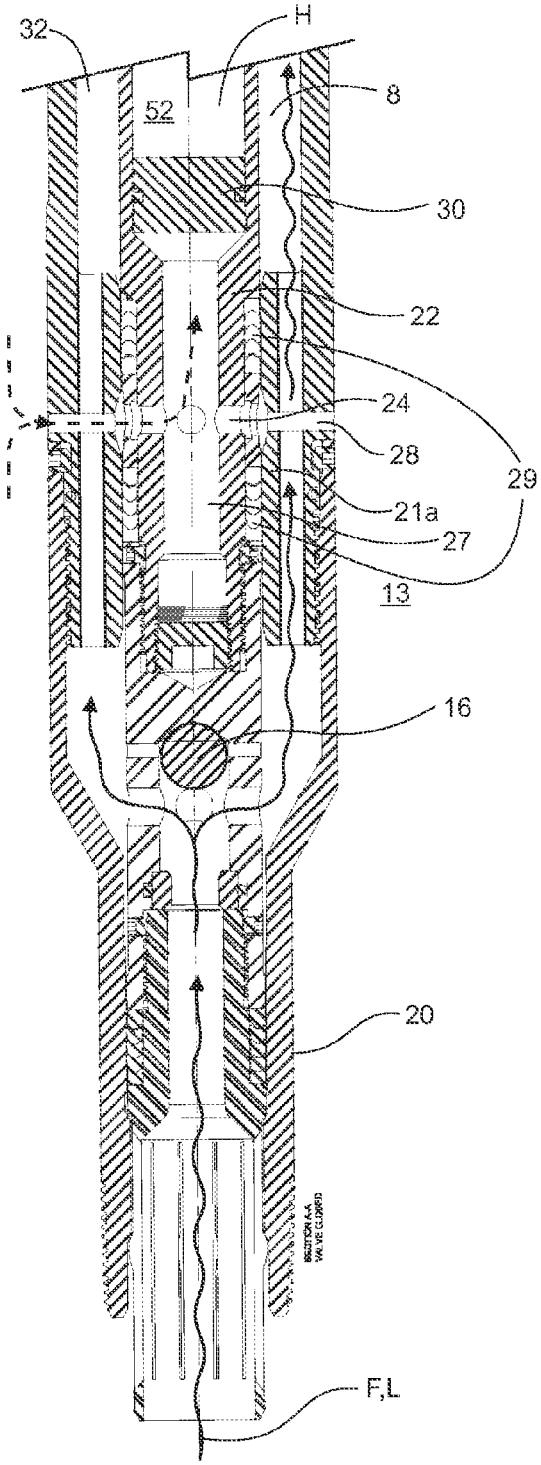
FIGS. 3A-3C are partial longitudinal sectional views according to FIGS. 1A-1C, the valve shown in the closed, production position

Best seen in FIGS. 3A-4C and in greater detail with reference to FIGS. 3A and 4A, the valve 10 comprises the valve body 22 fit to the tubing string 11. In this embodiment, the valve body 22 is sealingly engaged with the valve housing 20 at the bypass passages 21. The valve body 22 has a fluid bore 27. The pilot inlets 24 communicate with the fluid bore 27. The pilot inlets 24 extends through the valve body 22 from the fluid bore 27 and align with the one or more inlet passages 28 through the valve housing 20 to the wellbore annulus 13 external to the valve housing 20 and isolated from the production annulus 23. A first set of bypass passages 21*a*, extending axially through the valve housing 20, bypass production fluid L past the valve's pilot inlets 24. In this embodiment, it is convenient to axially extend the valve body 22 to also include the one-way valve 16 downhole of the pilot inlets 24. The one-way valve 16 can be a ball-and-seat type valve, sealingly engaging the valve housing 20 for directing production fluid L from the production inlet 19, through the one way valve 16, and out ports 17 in the valve body 22 into the production annulus 23 and bypass passages 21.

Figure 4B:
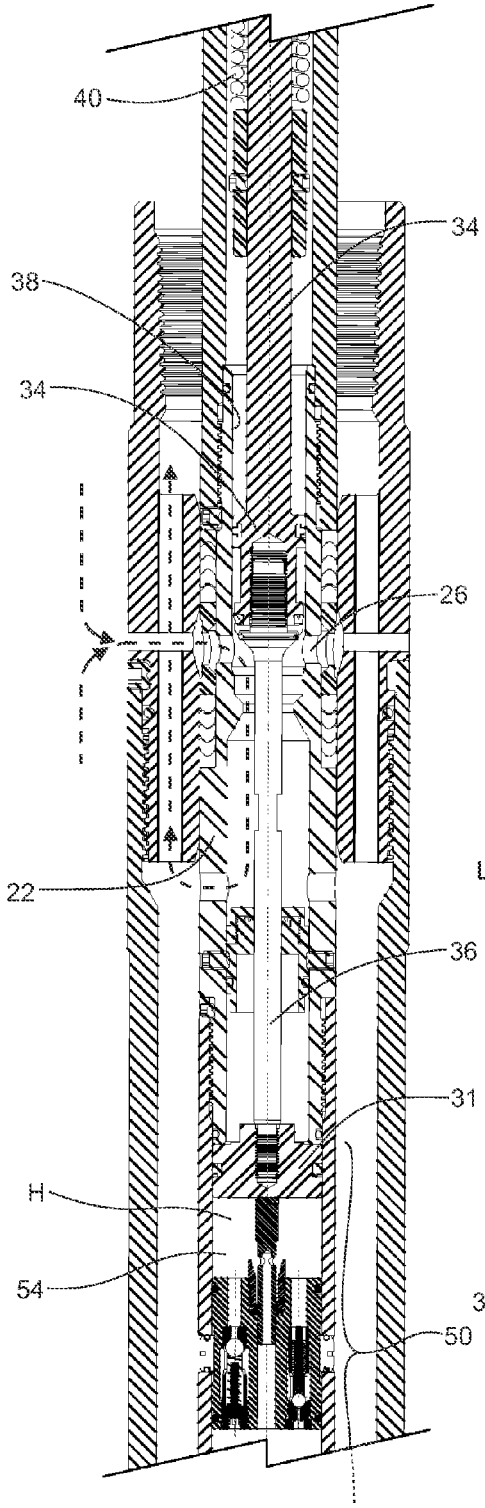
Figure 3B:
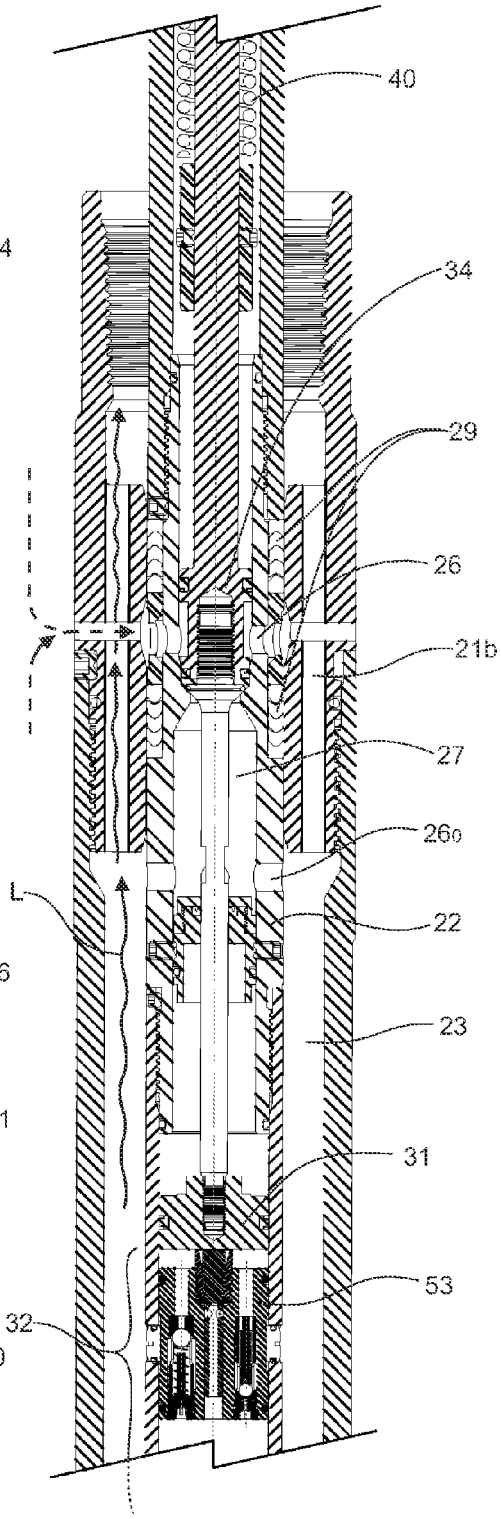

As shown in FIGS. 3B and 4B, bypass passages 21*b* isolate production fluid L from the valve's gas lift inlet ports 26. The one or more fluid outlets 26*o* extend through the valve body 22 from the fluid bore 27 to the production annulus 23 which is contiguous with the tubing annulus 8.

The valve body 22 is fit with annular seals 29 to seal the production annulus 23 uphole and downhole of the pilot inlet 24 and the gas lift inlet ports 26.

The open and closed operating positions are compared in FIGS. 3A-3C and 4A-4C, the valve's gas lift inlet ports 26 being alternately closed (FIGS. 3A, 3B and 3C) and opened (FIGS. 4A, 4B and 4C) through the action of a pressure-actuated pilot valve 50 having the first piston 30, the second piston 31 and the pressure modulator 53. The first and second pistons 30,31 are spaced from one another within the fluid bore 27 and define a hydraulic, pressure chamber 32 therebetween. The pressure chamber 32 is filled with the pilot liquid H.

The first piston 30 moves in response to pressure continuously communicated from the wellbore annulus 13 through the pilot inlets 24, which are aligned with inlet passages 28 in the valve body 22. The second piston 31 is operatively connected to the plunger 34. The plunger 34 is axially movable in a cylindrical bore 38 of the valve body 22. The second piston 31 and plunger 34 are biased by the main biasing spring 40 against the fluid pressure in fluid bore 27 for returning the plunger 34 to the production position, blocking the gas lift inlet ports 26 when the force generated by the fluid pressure falls below the biasing force. The second piston 31 is spaced from the plunger 34 by the piston rod 36 a sufficient distance to permit gas flowing from the inlet ports 26 to flow through the valve bore 49 to the outlet ports 26*o*.

Figures 5A, 5B:
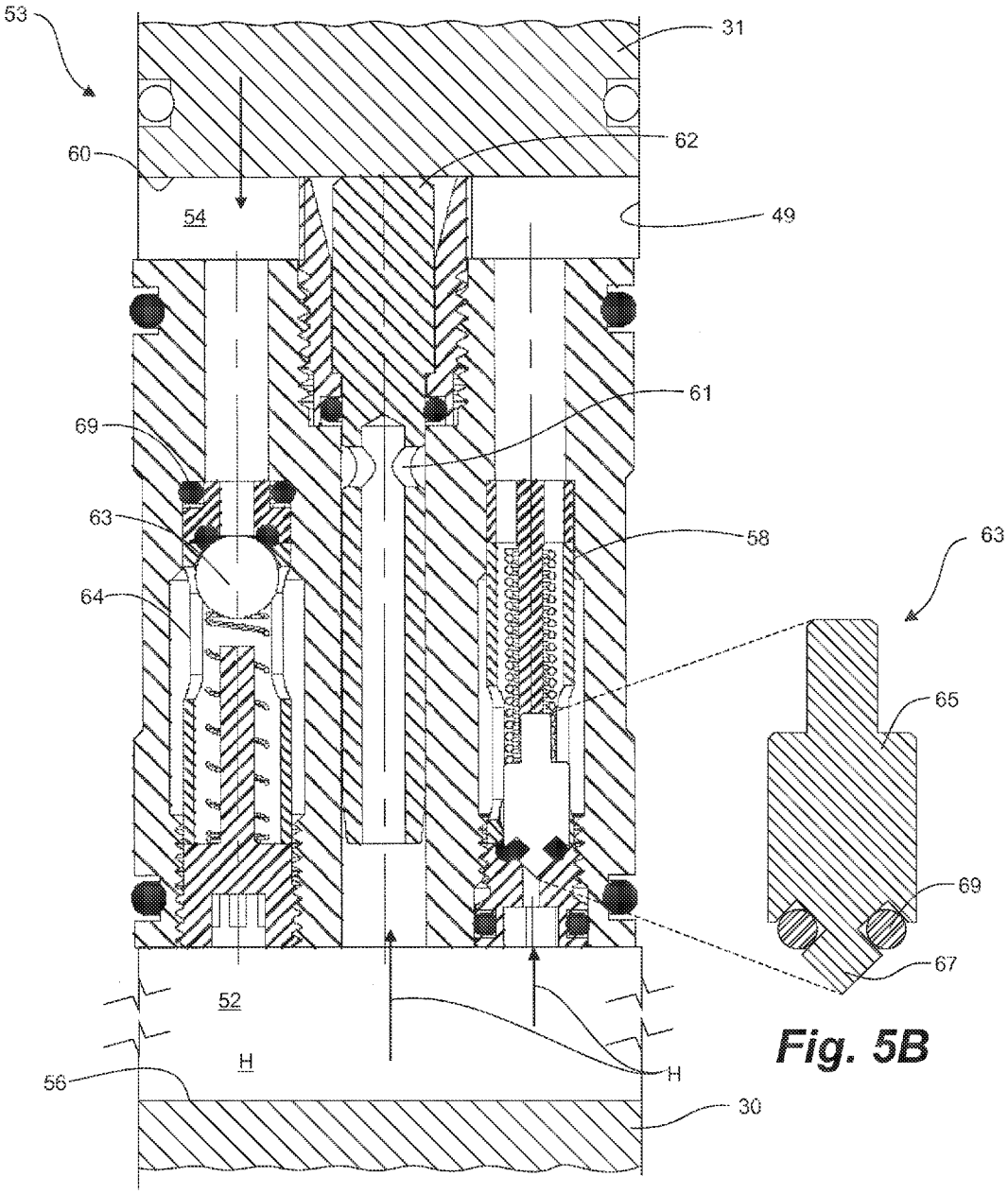
FIG. 5A is a detailed sectional view of a pilot valve incorporated in the valve according to FIGS. 1A-1C and 1D-1F.
FIG. 5B is a sectional view of a valve needle for an embodiment of the pilot valve, the needle having a tip and an O-ring seal integrated therein.

As shown in FIGS. 3B, 4B and 5A, the pressure modulator 53 is housed in the pressure chamber 32 between the first and second pistons 30,31 for forming the first chamber 52 between the first piston 30 and the pressure modulator 53 and the second chamber 54 between the pressure modulator 53 and the second piston 31. The pressure modulator 53 acts to communicate pressure, acting at a pressure face 56 of the first piston 30, to the second piston 31 and plunger 34 connected thereto for axially manipulating the plunger 34 across the gas lift inlet ports 26 to alternately unblock the gas lift inlet ports 26 in the open, lift position and to block the gas lift inlet ports 26 in the closed, production position. The pressure modulator 53 comprises any suitable pressure-actuated valve.

In an embodiment, best seen in FIG. 5A, the pressure modulator 53 comprises a high pressure release valve 58 which opens at a high preset pressure, such as from about 350 psi to about 400 psi. The high pressure valve 58 has spring-biased, valve internals 63 and an O-ring seal 69. When open, the high pressure valve 58 communicates pilot liquid H therethrough, from the first hydraulic chamber 52 to the second hydraulic chamber 54, to act at a pressure face 60 of the second piston 31. The pressure modulator 53 also incorporates a main valve 62 which opens sympathetically with movement of the second piston 31 to provide a supplementary flow port 61 therethrough to assist in communicating a greater rate of fluid through the pressure modulator 53 when open. Further, as the valve 10 closes, the pressure modulator 53 acts to bleed fluid pressure from the second chamber 54 back to the first chamber 52 through check valve 64, when the pressure in the annulus 13 decreases to a preset low pressure, such as to from about 100 psi to about 150 psi.

In an embodiment, shown in FIG. 5B, one or both of the ball-type, valve internals 63, such as fit to high pressure valve 58 and check valve 64 of FIG. 5A, are replaced with a needle 65 having a tip 67 and O-ring seal 69 integrated therein. The needle 65 more reliably retains the O-ring seal 69 upon opening.

Figure 5C:
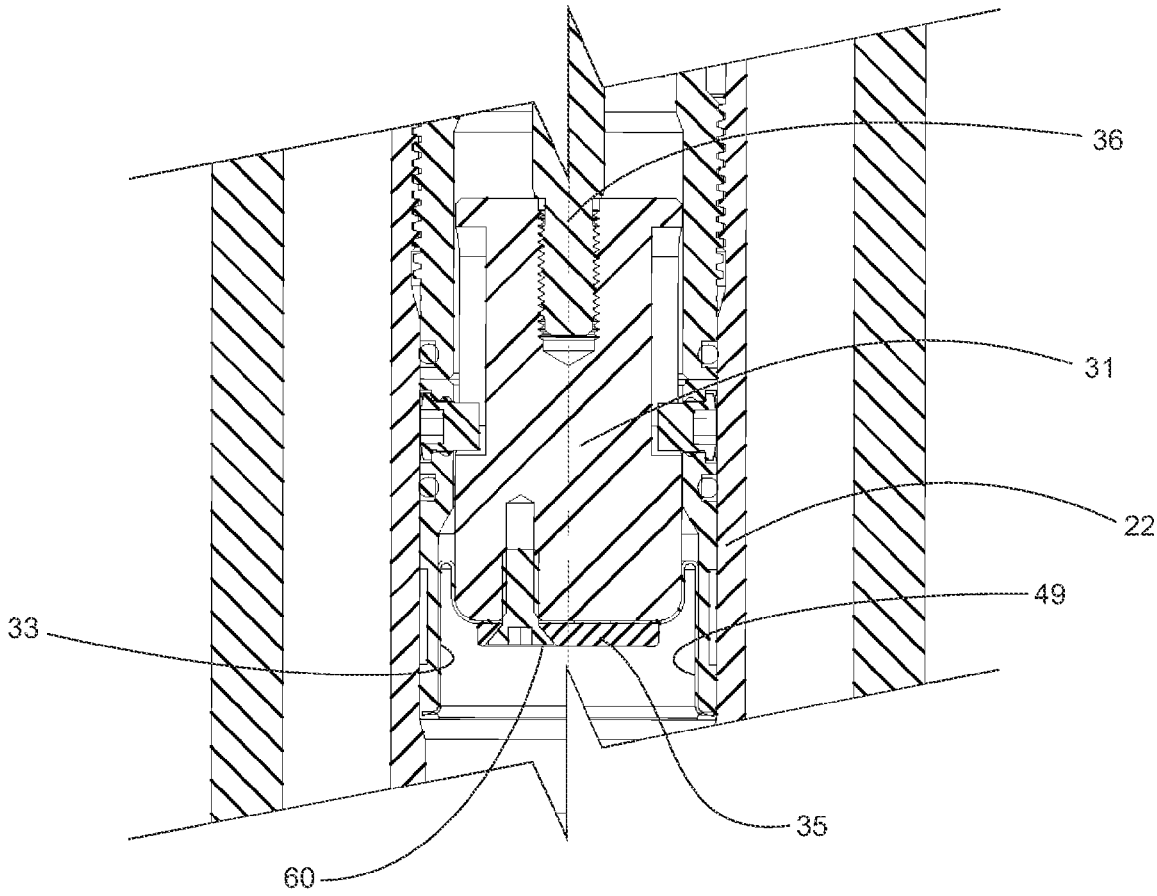
FIG. 5C is a sectional view of a second plunger piston according to an embodiment and having a diaphragm seal at a pressure face for sealing in the valve bore.

Having reference to FIG. 5C, and in an embodiment, second piston 31 can be fit with a diaphragm seal 33, to replace conventional sliding seals between the piston 31 and the valve body 22. The diaphragm seal 33 is retained to the second piston 31 by a retainer 35, which acts as a portion of the pressure face 60. Use of the diaphragm seal 33 reduces friction acting on the movement of the second piston 31 in the valve bore 49.

Returning to FIG. 5A, as the pressure in the annulus 13 decreases the pressure on the first piston 30 decreases. When the pressure differential across the pressure modulator 53 is sufficiently high, check valve 64 begins to open and pilot liquid H is released from chamber 54 to chamber 52, permitting the main spring 40 to bias the plunger 34 to the closed, production position and to block the gas lift inlet ports 26.

To ensure that the plunger 34 is fully actuated to the closed position, the valve-closing assist 70 is provided within the valve 10 to assist the main spring 40 and provide additional biasing force to ensure the plunger 34 is reliably moved to the closed position.

In an embodiment as shown in FIGS. 1A-1C, 1D-1F, 3C and 4C, the valve-closing assist 70 is a releasable locking mechanism comprising the kicker spring 72 which provides the additional biasing force to the plunger 34, and the second piston 31 connected thereto, to cause the valve 10 to reliably and completely close. The locking mechanism 70 acts when the pressure in the annulus 13 drops to about the preset low pressure LP and the plunger 34 is shifted to block the gas lift inlet ports 26.

The kicker spring 72 is initially prevented from acting against the plunger 34 until such time as the main biasing spring 40 has moved the plunger 34 to about the closed position.

Figure 4C:
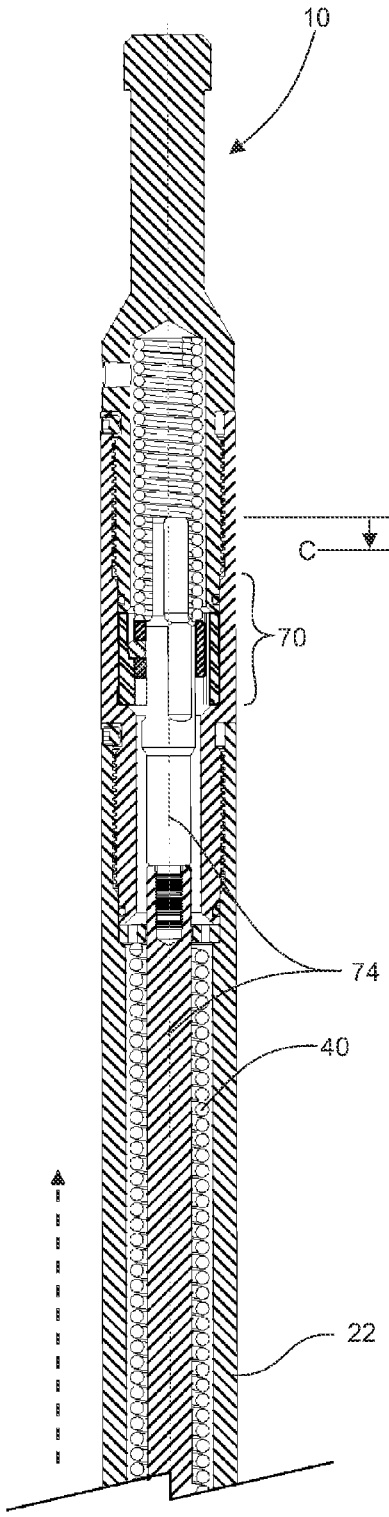
Figure 3C:
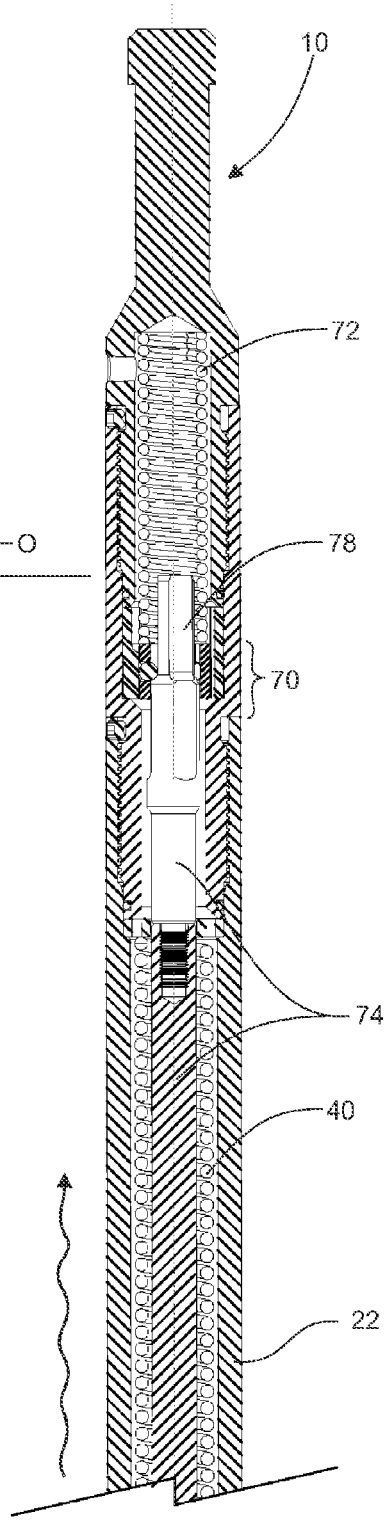
Figure 6:
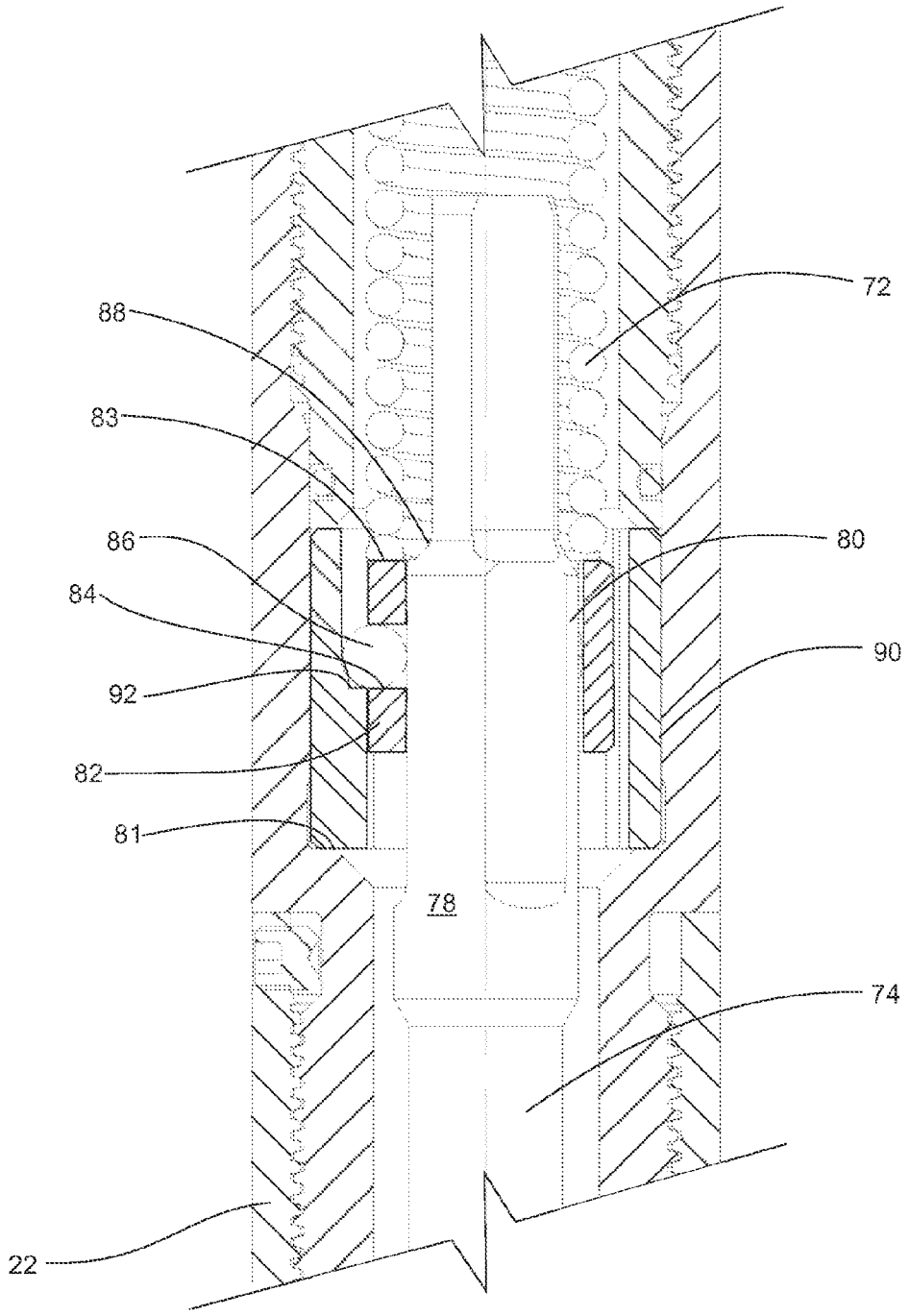
FIG. 6 is a detailed sectional view of a locking mechanism for staging the actuation of a kicker spring for moving the plunger to the fully closed position.

In greater detail, as shown in comparative FIGS. 3C, 4C and in detailed FIG. 6, the plunger 34 further comprises a main spring mandrel 74 which extends uphole within a spring bore 76 in the valve body 22. The main spring mandrel 74 supports the main biasing spring 40 thereon. A kicker spring mandrel 78 is connected at a distal or uphole end 79 of the main spring mandrel 74 for supporting the kicker spring 72 thereabout. The main spring mandrel 74 and kicker spring mandrel 78 are actuated to move axially with the plunger 34 within the spring bore 76 of the valve body 22.

A tubular kicker sleeve 82 is fit over a guide portion 80 of the kicker spring mandrel 78 and is axially moveable thereon. The kicker spring 72 engages an opposing end 83 of the kicker sleeve 82 for exerting a biasing force thereon. When released, the kicker spring 72 and kicker sleeve 82 urge axial movement of the plunger 34 to the closed, production position.

The kicker spring 72 and kicker sleeve 82 are initially energized as the plunger 34 is forced open by the pressure-actuated pilot valve 50. The kicker sleeve 82 is releasably locked in the energized state by locking the sleeve 82 to the valve body 22. As previously stated, the kicker spring 72 is prevented from exerting its biasing force on the plunger 34 until the main biasing spring 40 has acted. As the plunger 34 closes, the kicker spring mandrel 78 moves to a release position, releasing the sleeve 82 from the valve body 22 and permitting the kicker spring 72 to exert the stored energy for urging the kicker spring mandrel 78 and connected plunger 34 to the closed production position.

In an embodiment, the kicker sleeve 82 has a port 84 formed therein for housing a locking element or spherical ball 86. The kicker spring mandrel 78 has a shoulder 88 for engaging the spherical ball 86. A tubular kicker latch 90 is formed in the valve body 22 in the spring bore 76, the kicker sleeve 82 moving axially therethrough. The tubular kicker latch 90 has a profiled shoulder 92 for engaging the spherical ball 86.

When the plunger 34, the main spring mandrel 74 and the kicker spring mandrel 78 are moved together from the production position (FIG. 7B) to the lift position (FIG. 7A), the ball 86 engages shoulder 88 to drive the kicker sleeve 82 with the kicker spring mandrel 78. The sleeve 82 becomes aligned with the kicker latch 90 such that the spherical ball 86 moves within the port 84 and becomes engaged between the latch shoulder 92 of the valve body 22 and the sleeve port 84. The kicker spring mandrel 78 continues to move, free of the sleeve 82 and ball 86. The kicker spring mandrel 78 retains the ball 86 in the port 84 and engaged with the latch shoulder 92. The engagement of the spherical ball 86 between the latch shoulder 92 and the sleeve 82 prevents the kicker spring 72 from moving axially despite the biasing force exerted by the energized kicker spring 72 on the kicker sleeve 82.

In an embodiment, the kicker latch 90 is a latch sleeve 91, being a discrete component from the valve body 22 such as for manufacturing purposes. The kicker latch sleeve 91 is retained in the valve body 22 by a shoulder 81, extending inward from the valve body 22, secures the tubular kicker latch sleeve 91 in the valve body 22 and limits axial movement of the tubular kicker latch 90 and kicker sleeve 82 releasably locked thereto in the spring bore 76.

When the pressure in the wellbore annulus 13 falls to the preset low pressure LP, the main biasing spring 40 acts to move the plunger 34, the main spring mandrel 74 and the kicker spring mandrel 78 toward the closed production position. As the kicker spring mandrel 78 is moved axially, relative to the kicker sleeve 82, shoulder 88 on the kicker spring mandrel 78 aligns with the spherical ball 86. The ball 86 moves radially inward in port 84 and is released from the latch shoulder 92 and now engages between the kicker sleeve port 84 and the shoulder 88 in the kicker spring mandrel 78. The kicker sleeve 82 is released from the valve body 22 and becomes locked to the kicker spring mandrel 78. The biasing force exerted by the kicker spring 72 is imparted to the sleeve 82 and to the kicker spring mandrel 78 through ball 86 and shoulder 88. Thus, the plunger 34, connected thereto, is moved a final distance if not already fully closed to ensure the pressure-actuated valve 10 is in the fully closed, production position.

Figure 7B:
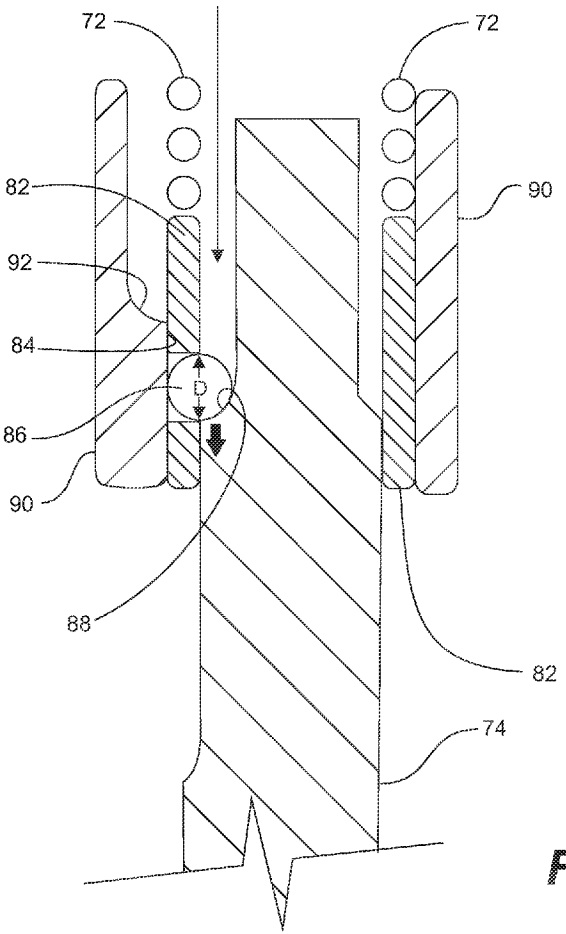
FIGS. 7A and 7B are partial sectional, simplified views of the locking mechanism of FIG. 6, more particularly
Figure 7A:
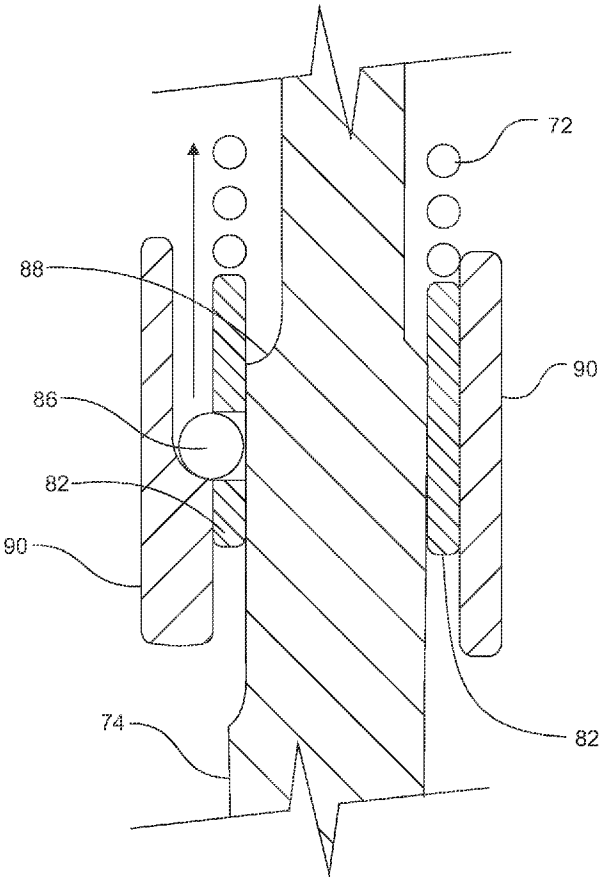

Having reference to FIGS. 7A and 7B, in a schematic representation of the interface of the kicker latch 90, the kicker sleeve 82 and the kicker spring mandrel 74, the spherical ball 86 has a diameter D that is greater than an annular thickness d of the kicker sleeve 82. Therefore, the ball 86 can only be engaged between port 84 and shoulder 88 or between port 84 and latch shoulder 92. When engaged between port 84 and latch shoulder 92, the ball 86 is locked therein by the kicker spring mandrel 78. When engaged between port 84 and shoulder 88, the ball is locked therein by the valve body 22 at kicker latch 90.

As shown in FIG. 7A, when the shoulder 92 of the kicker latch 90 is aligned with the sleeve port 84, the ball 86 extends from the port 84 into the latch profile 92 for engaging the kicker sleeve 82 thereto preventing movement of the sleeve 82 by the kicker spring 72.

As shown in FIG. 7B at the preset low pressure, when the kicker spring mandrel 74, with the plunger 34 attached thereto, has been moved downhole as a result of the biasing force of the main biasing spring 40, the mandrel shoulder 88 becomes aligned with the port 84 in the sleeve 82. The spherical ball 86 moves out of the latch shoulder 92 and enters the mandrel shoulder 88, unlocking the sleeve 82 from the latch 90 and permitting the sleeve 82 and kicker spring mandrel 78 to be actuated to move axially and apply the spring force of the kicker spring 72 for ensuring the plunger 34 is closed fully and blocking the fluid inlet ports 26.

In an embodiment, the high preset pressure is from about 350 psi to about 400 psi and the preset low pressure is from about 100 psi to about 150 psi. The kicker spring mandrel 78 can approach the closed, production position to a final axial distance of about 1/16 inch before shoulder 88 aligns with port 84 for releasing the kicker sleeve 82.

One of skill in the art would understand that the high and low pressure thresholds are limited only by the selection of the rating of the springs used, such as in the valve 10 and the pressure modulator 53, and the compressor used to pressure the wellbore annulus.

The embodiments of the invention in which an exclusive property or privilege is claimed are defined as follows:

1. A system for enhancing gas recovery from a wellbore extending to a reservoir having diminished pressure, the wellbore having a tubing string therein, a packer and compressed gas for pressurizing a wellbore annulus, the packer being set, above perforations, between a casing string and the tubing string for forming the wellbore annulus thereabove, liquids accumulating in a bore of the tubing string as wellbore gas is produced therethrough to surface, the system comprising:

a one-way valve at a bottom of the tubing string for one-way fluid communication from the reservoir to the tubing string; and a pressure-actuated valve, housed in the bore of the tubing string uphole from the one-way valve and forming a production annulus therebetween in fluid communication with the tubing annulus, the pressure-actuated valve comprising:

a valve body having a valve bore;

inlet ports for fluid communication between the wellbore annulus and the valve bore;

outlet ports in the valve body, spaced downhole from the inlet ports, for fluid communication between the valve bore and the production annulus;

a plunger axially moveable in the valve bore, uphole from the inlet ports, for alternately blocking the inlet ports for preventing gas accumulating in the wellbore annulus from entering the valve body in a closed, production position; and unblocking the inlet ports for admitting gas from the wellbore annulus to the valve bore and flowing through the outlet ports to the production annulus for lifting accumulated fluids therein to surface in an open, lift position;

a main spring operatively connected to the plunger for normally biasing the plunger downhole to the production position; and a pressure-actuated pilot valve system positioned in the valve bore and in continuous pressure communication with the wellbore annulus, wherein when the pressure in the wellbore annulus exceeds a preset high pressure, the pilot valve opens to communicate the high pressure to the plunger for overcoming the biasing and moving the plunger from the production position to the open, lift position; and when the pressure in the wellbore annulus is below a preset low pressure, the pilot valve releases the pressure acting at the plunger, allowing the plunger to be biased from the lift position to the closed, production position.

2. The system of claim 1 wherein the pressure-actuated pilot valve system comprises:

a first, free-floating piston housed within the valve bore, downhole from the plunger;

a second piston spaced from the first piston in the valve bore for forming a hydraulic chamber therebetween and containing pilot liquid, the second piston being operatively connected to the plunger by a piston rod;

a pressure modulator, housed in the hydraulic chamber between the first and second pistons, separating the hydraulic chamber into first and second pressure chambers therein; and pilot inlets in the valve body below the first piston for communicating pressure from the wellbore annulus to the first piston, wherein the second piston is spaced from the plunger by the piston rod for flowing gas to the valve bore and to the outlet ports for flowing gas to the production annulus, when the plunger is in the lift position.

3. The system of claim 2, wherein the second piston is sealingly engaged in the valve bore.

4. The system of claim 3 wherein the second piston is sealing engaged by a diaphragm seal acting between the second piston and the valve body and retained to the piston at a pressure face of the second piston.

5. The system of claim 2 wherein the pressure modulator further comprises:

a high pressure release valve which opens at the preset high pressure for communicating pilot liquid therethrough from the first chamber to the second chamber;

a main valve which opens sympathetically with the second piston to open a supplementary flow port therethrough to communicate a greater rate of pilot liquid through the pilot valve; and a check valve for controlling return of pilot liquid from the second chamber to the first chamber at the preset low pressure.

6. The system of claim 5 wherein the high pressure release valve and the check valve have ball-type valve internals.

7. The system of claim 5 wherein the high pressure release valve comprises a plunger having a needle tip and O-ring for sealing in the pressure modulator.

8. The system of claim 1 further comprising a valve-closing assist for releasing energy to the plunger for assisting the plunger to move to the production position after the plunger has been actuated to move to the production position.

9. The system of claim 8 wherein the valve-closing assist is a kicker spring operatively connected to the plunger, the kicker spring being energized to an energized state when the plunger is moved to the lift position and releasably retained in the energized state until the plunger is moved to the production position; and which thereafter releases stored energy to the plunger to assist the plunger to move to the production position.

10. The system of claim 9 wherein the kicker spring is releasably retained in the energized state by locking elements acting between the valve body and the kicker spring.

11. The system of claim 9 wherein the main spring is supported from the plunger by a main spring mandrel extending uphole therefrom, the valve-closing assist further comprising:

a kicker spring mandrel connected at an uphole end of the main spring mandrel for supporting the kicker spring thereon, the main spring mandrel and the kicker spring mandrel being actuated to move axially within a spring bore in the valve body;

a tubular kicker sleeve, fit over a portion of the kicker spring mandrel, the sleeve being axially moveable thereon, the kicker spring engaging an end of the sleeve for exerting a biasing force thereto;

a port formed in the sleeve for engaging a locking element therein;

a shoulder in the kicker spring mandrel for engaging the locking element; and a shoulder in the spring bore for engaging the locking element, wherein when the plunger, the main spring mandrel and the kicker spring mandrel are moved to the lift position, the port in the sleeve becomes aligned with the shoulder in the spring bore for engaging the locking element therebetween, for locking the sleeve and the kicker spring to the valve body; and when the plunger, the main spring mandrel and the kicker spring mandrel are biased toward the production position, the shoulder on the kicker spring mandrel becomes aligned with the locking element, the locking element moves radially inward into the port in the sleeve and the kicker spring mandrel, releasing the kicker sleeve from the valve body and permitting the kicker spring to bias the kicker spring mandrel and the plunger connected thereto to assist the plunger to move to the production position.

12. The system of claim 11 wherein the locking element is a spherical ball having a diameter greater than a depth of the port in the sleeve.

13. The system of claim 1 wherein the preset high pressure is from about 350 psi to about 400 psi and the preset low pressure is from about 100 psi to about 150 psi.

14. A pressure-actuated valve for alternately fluidly communicating between a wellbore annulus being pressurized with gas and a tubing annulus, the valve being housed in a tubing string forming the tubing annulus, the tubing string being hung in a wellbore and forming the wellbore annulus above a packer set therein, the valve comprising:

a valve body having a valve bore;

inlet ports for fluid communication between the wellbore annulus and the valve bore;

outlet ports in the valve body, spaced below the inlet ports, for fluid communication between the valve bore and the production annulus;

a plunger axially moveable in the valve bore, above the inlet ports, for alternately blocking the inlet ports for preventing gas accumulating in the wellbore annulus from entering the valve body in a closed, production position; and unblocking the inlet ports for admitting the gas from the wellbore annulus to the valve bore and flowing through the outlet ports to the production annulus for lifting accumulated fluids therein to surface in an open, lift position;

a main spring operatively connected to the plunger for normally biasing the plunger to the closed, production position; and a pressure-actuated pilot valve system positioned in the valve bore and in continuous pressure communication with the wellbore annulus, wherein when the pressure in the wellbore annulus exceeds a preset high pressure, the pilot valve opens to communicate the high pressure to the plunger for overcoming the biasing and moving the plunger from the closed, production position to the open, lift position; and when the pressure in the wellbore annulus is below a preset low pressure, the pilot valve releases the pressure acting at the plunger, allowing the plunger to be biased from the open, lift position to the closed, production position.

15. The valve of claim 14 wherein the pressure-actuated pilot valve system comprises:

a first, free-floating piston housed within the valve bore, downhole from the plunger;

a second piston spaced from the first piston in the valve bore for forming a hydraulic chamber therebetween, the second piston being operatively connected to the plunger by a piston rod;

a pressure modulator, housed in the hydraulic chamber between the first and second pistons, separating the hydraulic chamber into first and second pressure chambers therein; and pilot inlets in the valve body downhole from the first piston for communicating pressure from the wellbore annulus to the first piston, wherein the second piston is spaced from the plunger by the piston rod for flowing gas to the valve bore and to the outlet ports for flowing gas to the production annulus, when the plunger is in the lift position.

16. The valve of claim 15 wherein the pressure modulator further comprises:

a high pressure release valve which opens at the preset high pressure for communicating pilot liquid therethrough from the first chamber to the second chamber;

a main valve which opens sympathetically with the second piston forming a supplementary flow path therethrough to communicate a greater rate of pilot liquid through the pilot valve; and a check valve for controlling return of pilot liquid from the second chamber to the first chamber at the preset low pressure.

17. The valve of claim 16 wherein the second piston is sealingly engaged in the valve bore.

18. The valve of claim 17 wherein the second piston is sealing engaged by a diaphragm seal acting between the second piston and the valve body and retained to the piston at a pressure face of the second piston.

19. The valve of claim 16 wherein the high pressure bypass valve and the check valve have ball-type valve internals.

20. The valve of claim 16 wherein the high pressure release valve comprises a plunger having a needle tip and O-ring for sealing in the pressure modulator.

21. The valve of claim 14 further comprising a valve-closing assist for releasing energy to the plunger for assisting the plunger to move to the closed, production position after the plunger has been actuated to move toward the closed, production position.

22. The valve of claim 14 wherein the preset high pressure is from about 350 psi to about 400 psi and the preset low pressure is from about 100 psi to about 150 psi.

23. A valve-closing assist for a valve, biased to a closed position by a main spring, for ensuring the valve is in a fully closed position, the valve-closing assist comprising:

a kicker spring operatively connected to the main spring, the kicker spring being energized to an energized state when the main spring is overcome and the valve is moved to an open position, the kicker spring being releasably retained in the energized state until the main spring is moved to the closed position; and which thereafter releases stored energy to the main spring to assist the valve to be in the closed position;

and releasably retained in the energized state by a locking element acting operatively between a valve body and the kicker spring.

24. The valve-closing assist of claim 23 wherein the main spring is supported by a main spring mandrel, the valve-closing assist further comprising:

a kicker spring mandrel connected at an uphole end of the main spring mandrel for supporting the kicker spring thereon, the main spring mandrel and the kicker spring mandrel being actuated to move axially within a spring bore in the valve body;

a tubular kicker sleeve, fit over a portion of the kicker spring mandrel, the sleeve being axially moveable thereon, the kicker spring engaging an end of the sleeve for exerting a biasing force thereto;

a port formed in the sleeve for engaging the locking element therein;

a shoulder in the kicker spring mandrel for engaging the locking element; and a shoulder in the spring bore for engaging the locking element, wherein when the plunger, the main spring mandrel and the kicker spring mandrel are moved to the lift position, the port in the sleeve becomes aligned with the shoulder in the spring bore for engaging the locking element therebetween, for locking the sleeve and the kicker spring to the valve body; and when the plunger, the main spring mandrel and the kicker spring mandrel are biased toward the production position, the shoulder on the kicker spring mandrel becomes aligned with the locking element, the locking element moves radially inward into the port in the sleeve and the kicker spring mandrel, releasing the kicker sleeve from the valve body and permitting the kicker spring to bias the kicker spring mandrel and the plunger connected thereto to assist the plunger to move to the production position.

25. The valve-closing assist of claim 24 wherein the locking element is a spherical ball having a diameter greater than a depth of the port in the sleeve.

* * * * *